US009108410B2

(12) United States Patent
Hamasaki et al.

(10) Patent No.: US 9,108,410 B2
(45) Date of Patent: Aug. 18, 2015

(54) PRINTING APPARATUS AND CONTROL METHOD

(71) Applicant: CANON KABUSHIKI KAISHA, Tokyo (JP)

(72) Inventors: Yuji Hamasaki, Kawasaki (JP); Atsushi Takahashi, Tama (JP); Kei Kosaka, Tokyo (JP); Hirokazu Yoshikawa, Yokohama (JP); Tomoyuki Tenkawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/444,053

(22) Filed: Jul. 28, 2014

(65) Prior Publication Data

US 2015/0042715 A1 Feb. 12, 2015

(51) Int. Cl.

| | |
|---|---|
| ***B41J 2/045*** | (2006.01) |
| ***B41J 11/00*** | (2006.01) |
| ***B41J 2/165*** | (2006.01) |

(52) U.S. Cl.

CPC ..... *B41J 2/16526* (2013.01); *B41J 11/003* (2013.01); *B41J 11/008* (2013.01); *B41J 2/16508* (2013.01); *B41J 2002/16573* (2013.01)

(58) Field of Classification Search

CPC ..... B41J 29/38; B41J 11/008; B41J 2/0458; B41J 2/04598; B41J 2/07; B41J 2/165

USPC ..... 347/14–16, 19, 20, 35, 54, 57, 60

See application file for complete search history.

(56) References Cited

U.S. PATENT DOCUMENTS

| | | | | |
|---|---|---|---|---|
| 6,834,929 | B1 * | 12/2004 | Adams et al. | 347/19 |
| 7,014,292 | B2 | 3/2006 | Yazawa et al. | |
| 7,207,649 | B2 | 4/2007 | Ide et al. | |
| 7,445,309 | B2 | 11/2008 | Ide et al. | |
| 7,703,879 | B2 | 4/2010 | Yazawa et al. | |
| 7,794,044 | B2 | 9/2010 | Yoshikawa et al. | |
| 7,997,681 | B2 | 8/2011 | Yoshikawa et al. | |
| 8,083,311 | B2 | 12/2011 | Ide et al. | |
| 8,201,919 | B2 | 6/2012 | Mizoguchi et al. | |
| 8,517,503 | B2 | 8/2013 | Mizoguchi et al. | |
| 2010/0238222 | A1 * | 9/2010 | Jogo et al. | 347/14 |
| 2013/0100200 | A1 | 4/2013 | Hamasaki et al. | |
| 2013/0148144 | A1 * | 6/2013 | Tao | 358/1.12 |

FOREIGN PATENT DOCUMENTS

| | | | |
|---|---|---|---|
| JP | 2004-082412 | A | 3/2004 |
| JP | 2005-238712 | A | 9/2005 |
| JP | 2007-021984 | A | 2/2007 |

* cited by examiner

*Primary Examiner* — Thinh Nguyen

(74) *Attorney, Agent, or Firm* — Fitzpatrick, Cella, Harper & Scinto

(57) ABSTRACT

The present invention provides a printing apparatus including, a printhead; a preliminary discharge unit; a detecting unit detecting a size of a printing medium; and a scaling process unit. The scaling process unit scales an image to be formed on the printing medium in accordance with a detected size when a size of a printing medium indicated by size setting information and the detected size do not match each other. The preliminary discharge unit causes the printhead to perform preliminary discharge in accordance with a scaling result of the scaling process unit.

20 Claims, 11 Drawing Sheets

FIG. 7A

| PRINT MODE | SIZE | TARGET NOZZLE | NUMBER OF DISCHARGE TIMES |
|---|---|---|---|
| PHOTO PRINTING | < PRE-DETERMINED SIZE | MBk | 100 |
| | | MBk | 100 |
| | | MBk | 100 |
| | | C SMALL, M SMALL, Gy SMALL | 35 |
| | | C MIDDLE, M MIDDLE, Gy MIDDLE | 35 |
| | | C LARGE | 15 |
| | | M LARGE | 15 |
| | | Gy LARGE | 15 |
| | | Pk LARGE | 15 |
| | | Y LARGE | 15 |

FIG. 7B

| PRINT MODE | SIZE | TARGET NOZZLE | NUMBER OF DISCHARGE TIMES |
|---|---|---|---|
| PHOTO PRINTING | ≥ PRE-DETERMINED SIZE | MBk | 100 |
| | | MBk | 100 |
| | | MBk | 100 |
| | | C SMALL, M SMALL, Gy SMALL | 70 |
| | | C MIDDLE, M MIDDLE, Gy MIDDLE | 50 |
| | | C LARGE | 1200 |
| | | C LARGE | 2400 |
| | | M LARGE | 15 |
| | | Gy LARGE | 1800 |
| | | Gy LARGE | 3600 |
| | | Pk LARGE | 15 |
| | | Y LARGE | 315 |

FIG. 7C

| PRINT MODE | SIZE | TARGET NOZZLE | NUMBER OF DISCHARGE TIMES |
|---|---|---|---|
| PHOTO PRINTING | ≥ PRE-DETERMINED SIZE | MBk | 100 |
| | | MBk | 100 |
| | | MBk | 100 |
| | | C SMALL, M SMALL, Gy SMALL | 70 |
| | | C MIDDLE, M MIDDLE, Gy MIDDLE | 50 |
| | | C LARGE | 1000 |
| | | C LARGE | 2000 |
| | | M LARGE | 15 |
| | | Gy LARGE | 1500 |
| | | Gy LARGE | 2000 |
| | | Pk LARGE | 15 |
| | | Y LARGE | 315 |

PRINTING APPARATUS AND CONTROL METHOD

BACKGROUND OF THE INVENTION

1. Field of the Invention

The present invention relates to a printing apparatus.

2. Description of the Related Art

A printing apparatus typified by an inkjet printing apparatus is known to perform a recovery operation such as preliminary discharge in order to maintain, in a satisfactory state, discharge ports for discharging ink (for example, Japanese Patent Laid-Open Nos. 2004-82412, 2007-21984, and 2005-238712). Preliminary discharge is an operation of discharging ink not contributing to image printing. The purpose of preliminary discharge is to, for example, prevent drying of ink in the discharge port, and discharge highly viscous ink.

In general, the user sets the size of a printing medium such as paper on which an image is printed. However, the size of a printing medium actually prepared in a printing apparatus sometimes differs from the size set by the user. When the set size of a printing medium and the size of an actual printing medium are different, if the printing operation is performed without any change, this may result in a finish not intended by the user. When the size of an actual printing medium is smaller than the set size, ink may be discharged outside the printing medium and contaminate the inside of the printing apparatus.

As a measure when the set size of a printing medium and the size of an actual printing medium are different, an image may be scaled in accordance with the size of the actual printing medium. However, if the image size is changed, the use state of discharge ports in image printing also changes. This may influence the discharge port state.

SUMMARY OF THE INVENTION

The present invention provides a technique capable of high-quality printing even when the size of an actual printing medium differs from a set size.

According to an aspect of the present invention, there is provided a printing apparatus comprising: a printhead configured to print an image by discharging ink to a printing medium; a preliminary discharge unit configured to cause the printhead to perform preliminary discharge; a detecting unit configured to detect a size of a printing medium on which an image is to be printed; and a scaling process unit configured to, when a size of a printing medium indicated by size setting information and a detected size of the printing medium that has been detected by the detecting unit do not match each other, scale the image to be formed on the printing medium in accordance with the detected size, wherein the preliminary discharge unit is configured to cause the printhead to perform preliminary discharge in accordance with a scaling result of the scaling process unit.

Further features of the present invention will become apparent from the following description of exemplary embodiments (with reference to the attached drawings).

BRIEF DESCRIPTION OF THE DRAWINGS

FIGS. 7A to 7C are tables showing examples of the settings of preliminary discharge;

DESCRIPTION OF THE EMBODIMENTS

Embodiments of the present invention will now be described. In this specification, the term "printing" (to be also referred to as "print") not only includes the formation of significant information such as characters and graphics, but also broadly includes the formation of images, figures, patterns, and the like on a printing medium, or the process of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

Furthermore, the term "ink" (to be also referred to as a "liquid") should be extensively interpreted similar to the definition of "printing (print)" described above. That is, "ink" includes a liquid which, when applied onto a printing medium, can form images, figures, patterns, and the like, can process the printing medium, or can process ink (for example, solidify or insolubilize a coloring agent contained in ink applied to the printing medium).

First Embodiment

<Overall Arrangement>

Figure 1:
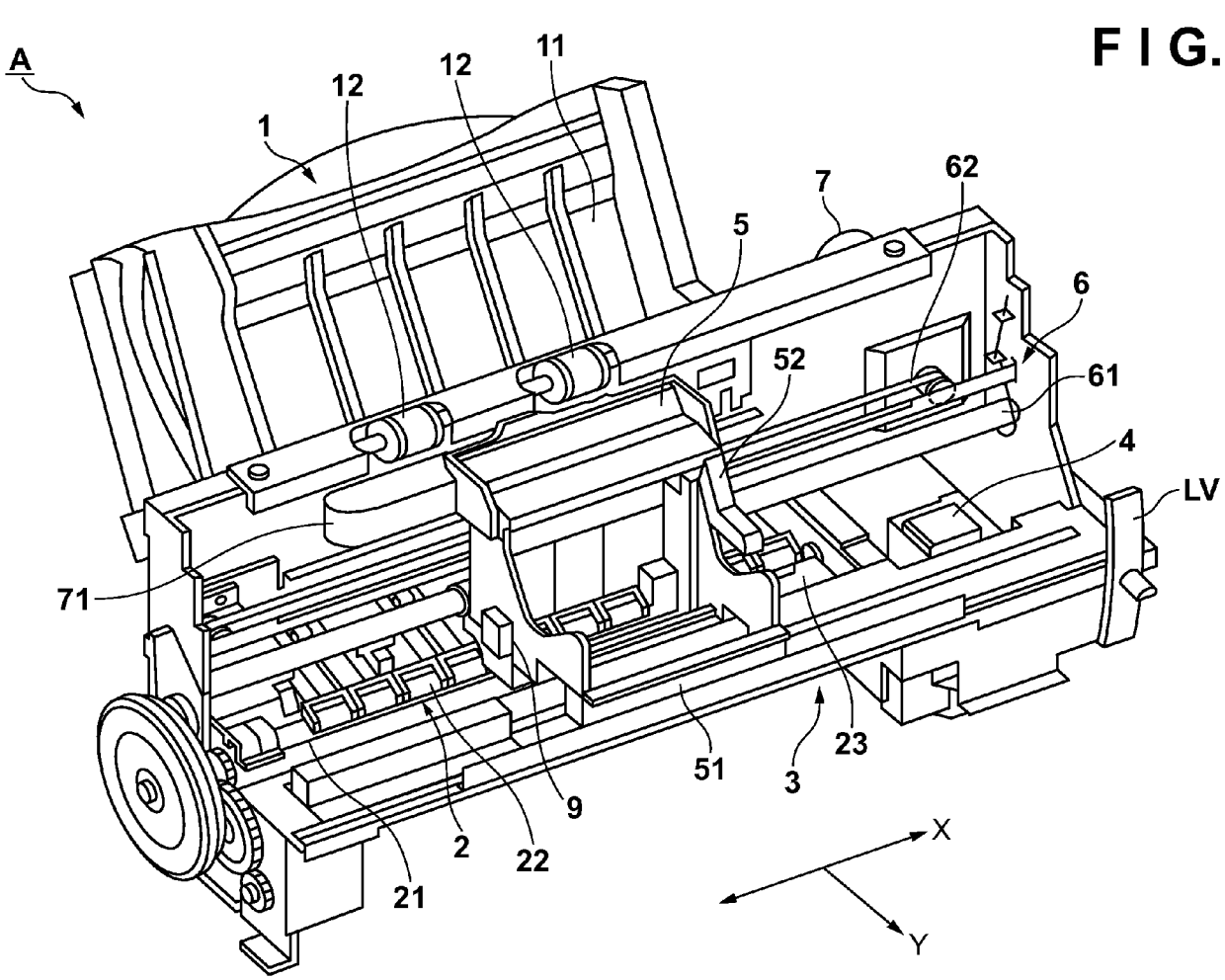
FIG. 1 is a schematic view showing a printing apparatus according to an embodiment of the present invention.

The first embodiment of the present invention will now be described with reference to the accompanying drawings. In the following embodiment, the present invention is applied to an inkjet printing apparatus. FIG. 1 is a schematic view showing a printing apparatus A according to the embodiment of the present invention. The printing apparatus A includes a feeding unit 1, conveying unit 2, discharging unit 3, recovery unit 4, carriage 5, moving unit 6, control unit 7, printing cartridge 8, and sensor 9. In FIG. 1, arrows X and Y indicate directions perpendicular to each other. The X direction will be called a main scanning direction, and the Y direction will be called a sub-scanning direction. The Y direction is a printing medium conveyance direction. The side of the feeding unit 1 will be called an upstream side, and the side of the discharging unit 3 will be called a downstream side.

The feeding unit 1 is an automatic feeding mechanism including a tray 11 on which a plurality of printing media are stacked, and feeding rollers 12. The feeding unit 1 conveys one by one the printing media on the tray 11 to the conveying unit 2 by the feeding rollers 12.

The conveying unit 2 is disposed downstream in the Y direction with respect to the feeding unit 1. The conveying unit 2 includes a conveyance roller 21 and pinch roller 22. A printing medium is clamped at the nip between the conveyance roller 21 and the pinch roller 22, and conveyed downstream in the Y direction along with rotation of the conveyance roller 21. The printing medium is conveyed on a platen 23 by the conveying unit 2, and the printing cartridge 8 (FIG. 2) mounted on the carriage 5 prints an image on the printing medium.

Figure 2:
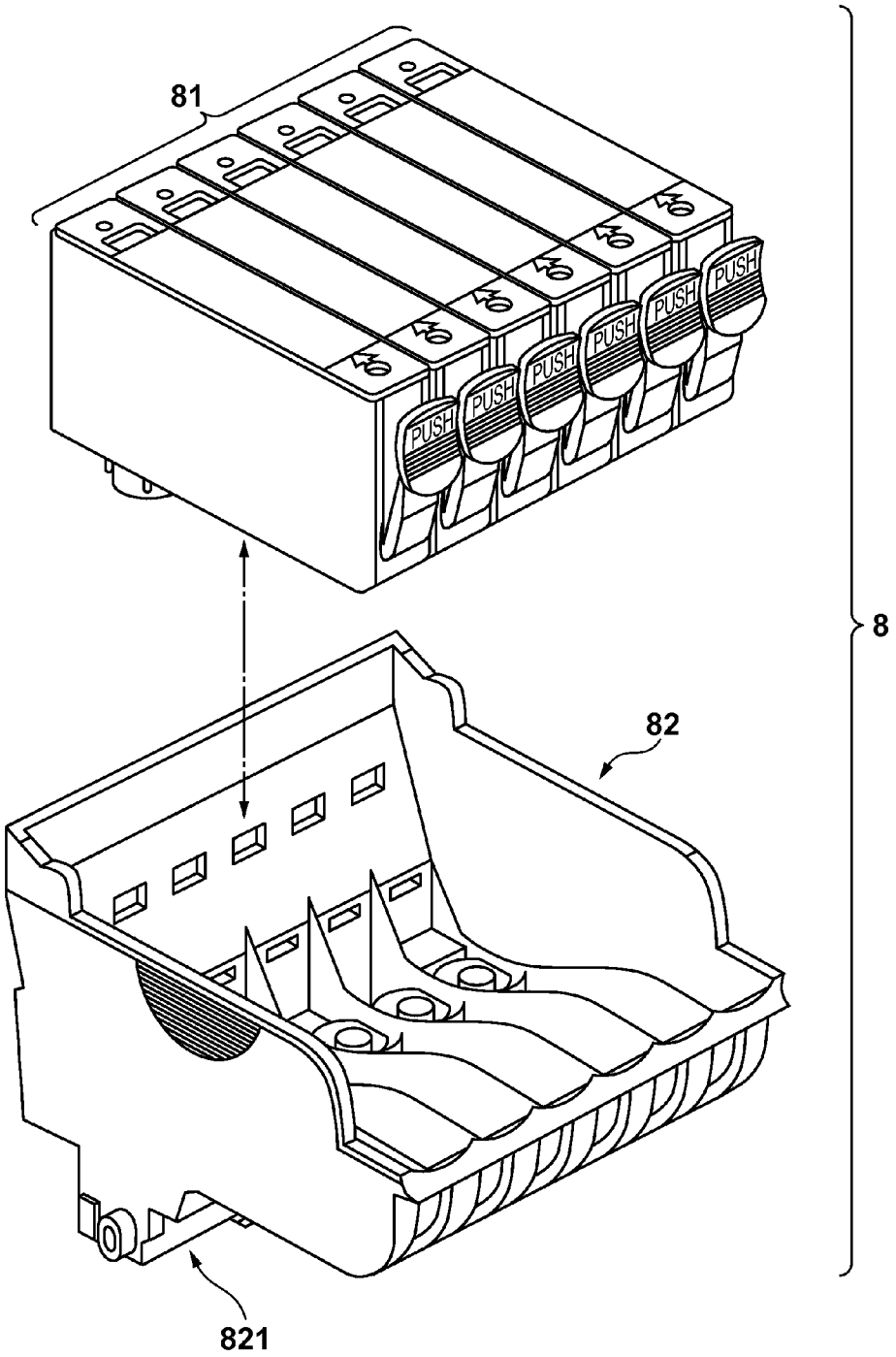
FIG. 2 is a schematic view showing a printing unit.

FIG. 2 is a view for explaining the printing cartridge 8. The printing cartridge 8 includes a plurality of ink tanks 81, and a printing unit 82. The respective ink tanks 81 store different types of inks. The ink types are, for example, color types such as black, light cyan, light magenta, cyan, magenta, and yellow. Other examples of the type are pigment and dye.

The printing unit 82 includes tank holders on which the respective ink tanks 81 are detachably mounted. The printing unit 82 includes a printhead 821. The printhead 821 is located at a position where it faces the platen 23. The printhead 821 includes a plurality of discharge ports for each ink type, and discharges ink supplied from each ink tank 81 to a printing medium to print an image.

Figure 3A:
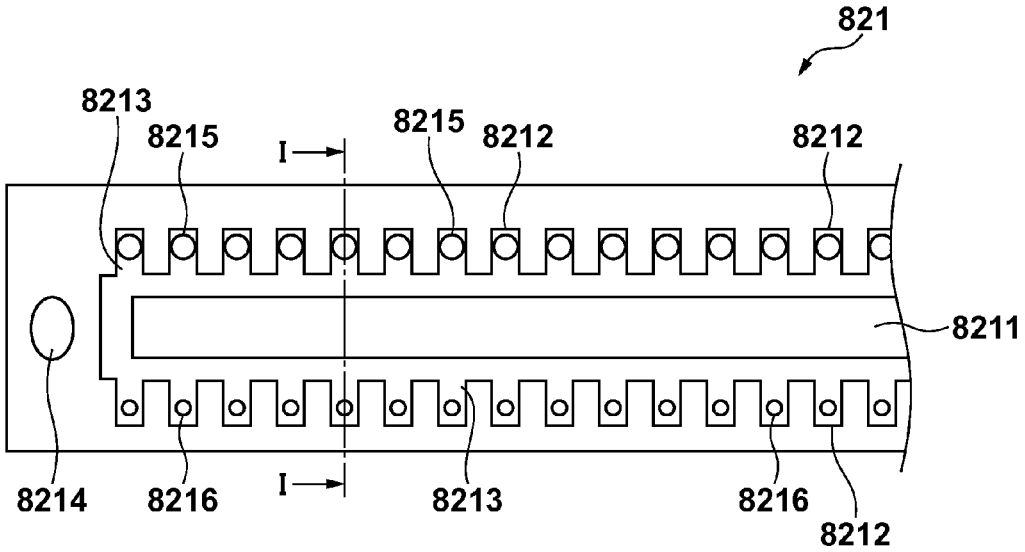
FIGS. 3A and 3B are views showing examples of the arrangement of a printing cartridge.
Figure 4A:
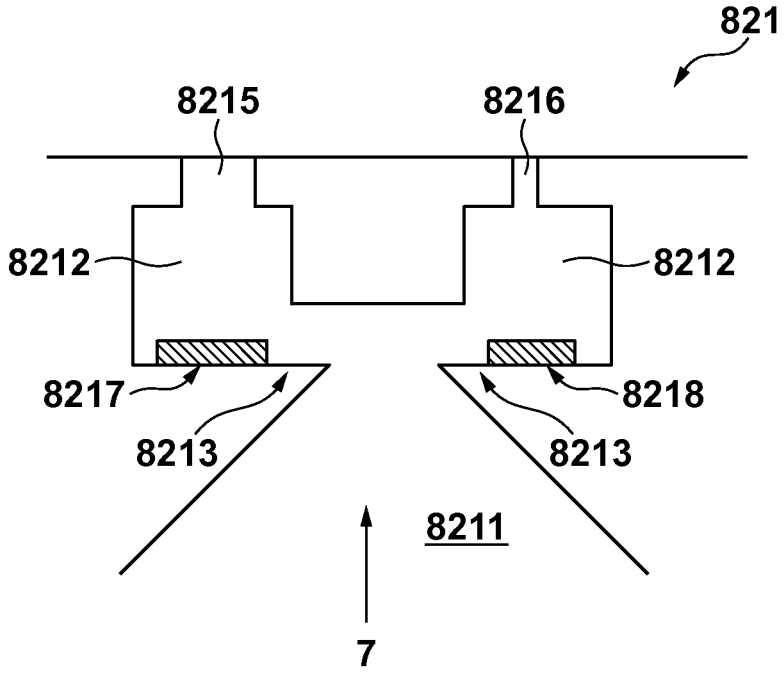
FIG. 4A is a sectional view taken along a line I-I in FIG. 3A.

FIG. 3A is a view for explaining the printhead 821, and is an enlarged view showing part of an ink discharge port formation surface. FIG. 4A is a sectional view taken along a line I-I in FIG. 3A. Note that the ink discharge port is sometimes called a nozzle.

Figure 3B:
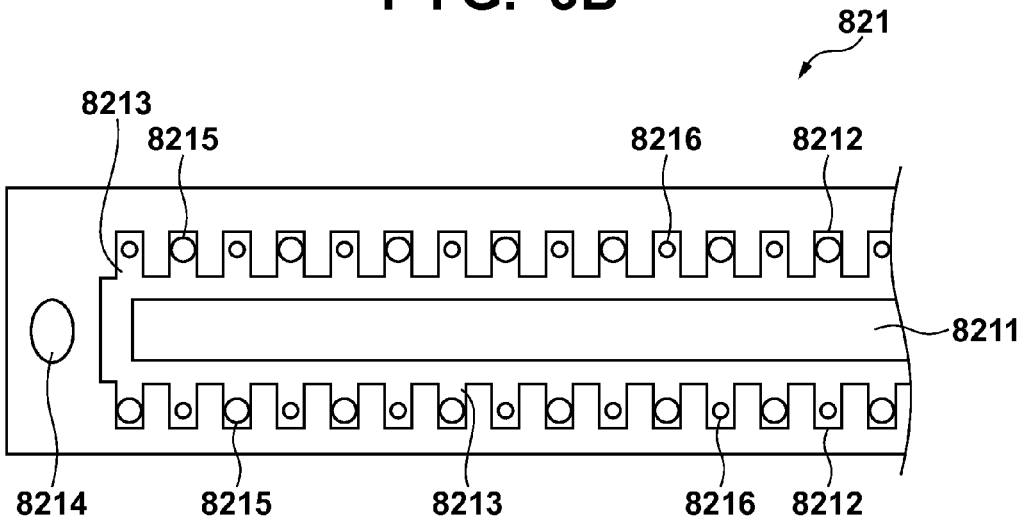

For each ink type, the printhead 821 includes a common liquid chamber 8211, ink bubbling chambers 8212, ink introducing portions 8213, ink discharge ports 8215 and 8216, heaters 8217 and 8218, and a temperature detecting element 8214. Ink is supplied to the respective ink discharge ports 8215 and 8216 via the common liquid chamber 8211 and ink introducing portions 8213. In the example of FIG. 3A, the ink discharge ports 8215 and 8216 are discharge ports different in size. The ink discharge port 8215 discharges a relatively large droplet, and the ink discharge port 8216 discharges a relatively small droplet. In the example of FIG. 3A, an array of the ink discharge ports 8215 and an array of the ink discharge ports 8216 are formed respectively. Alternatively, as in the example of FIG. 3B, the ink discharge ports 8215 and 8216 may coexist on the same array.

Note that the discharge ports may have one size, or have three or more sizes (for example, small, middle, and large). The discharge port type may be changed depending on the ink type.

The heaters 8217 and 8218 are electrothermal transducers which cause film boiling in ink. By bubbling energy at this time, ink can be discharged from the ink discharge ports 8215 and 8216. Note that the heaters 8217 and 8218 may be implemented by a common heater.

Referring back to FIG. 1, the position of the platen 23 can be adjusted by an adjustment lever LV. By the adjustment lever LV, the platen 23 can be moved to a position relatively close to the printhead 821 and a position relatively distant from it. Note that a configuration to move the printing cartridge 8 can also be employed.

When the platen 23 and printhead 821 come close to each other, the distance (called paper interval) between the printhead 821 and a printing medium at the time of image printing becomes short. For example, when printing a natural image on photo paper, the paper interval can be decreased to give priority to improvement of the ink dot landing accuracy. To the contrary, for example, when printing a character on plain paper, the paper interval can be increased to give priority to, for example, prevention of a rub between the printhead 821 and a printing medium.

The discharging unit 3 is disposed downstream in the Y direction with respect to the conveying unit 2. The discharging unit 3 includes a discharging roller (not shown), and conveys a printing medium outside the apparatus.

The recovery unit 4 is arranged at one end of the moving range of the carriage 5, and performs a recovery process on the printhead 821. The recovery unit 4 includes a cap (not shown) which caps the ink discharge port formation surface of the printhead 821. The cap may be connected to a suction pump capable of introducing a negative pressure into the cap. In this case, a negative pressure can be introduced into the cap covering the ink discharge ports of the printhead 821 to suck and discharge ink from the ink discharge ports. This is sometimes called a suction recovery process.

Ink not contributing to image printing can be discharged from the ink discharge ports into the cap. This is a mode of preliminary discharge and is sometimes called a discharge recovery process. As preliminary discharge, a mode in which ink not contributing to image printing is discharged at a location different from the cap can also be adopted.

The printing cartridge 8 is detachably mounted on the carriage 5. The carriage 5 includes a carriage cover 51 for guiding the printing unit 82 to a predetermined mounting position on the carriage 5. Further, the carriage 5 includes a setting lever 52 which is engaged with the tank holder of the printing unit 82 to set the printing unit 82 at a predetermined mounting position. The setting lever 52 is arranged to be pivotal about a lever shaft positioned above the carriage 5. A spring-biased setting plate (not shown) is arranged at a portion engaged with the printing unit 82. By this spring force, the setting lever 52 mounts the printing unit 82 on the carriage 5 while pressing the printing unit 82.

The printing unit 82 mounted on the carriage 5 has the printhead 821 interposed between the conveying unit 2 and the discharging unit 3. In other words, the image printing position of the printhead 821 is located between the conveying unit 2 and the discharging unit 3.

The moving unit 6 moves the carriage 5 in a direction perpendicular to the printing medium conveyance direction. In the embodiment, the moving unit 6 moves the carriage 5 in the X direction. The moving unit 6 includes a shaft 61 extending in the X direction, and a driving mechanism 62. The shaft 61 guides the movement of the carriage 5. In the embodiment, the driving mechanism 62 is a belt driving mechanism including a pair of pulleys spaced apart from each other in the X direction, and an endless belt wound between the pair of pulleys. Part of the endless belt is fixed to the carriage 5, and the carriage 5 moves in the X direction along with traveling of the endless belt. The position of the carriage 5 can be detected by, for example, an encoder scale extending in the X direction, and an encoder sensor arranged on the carriage 5.

Figure 4B:
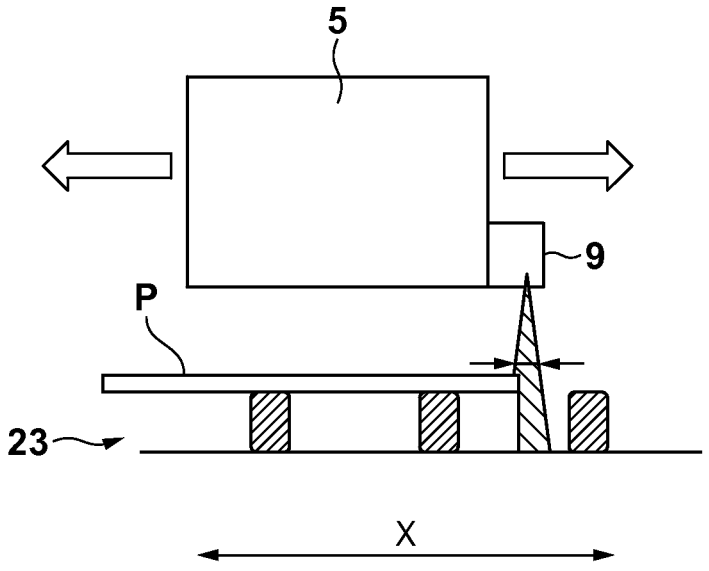
FIG. 4B is a view for explaining a sensor.

The sensor 9 is arranged on the carriage 5. The sensor 9 is, for example, a reflection optical sensor, and is used for reading of a registration adjustment pattern and the like. In the embodiment, the sensor 9 detects the size of a printing medium conveyed to a position where the printing medium faces the carriage 5. FIG. 4B is a view for explaining the sensor 9. The sensor 9 includes, for example, a light-emitting element which emits light toward the platen 23, and a light-receiving element which receives the reflected light. The detection position of the sensor 9 changes along with movement of the carriage 5. In a case in which a printing medium P exists at a position where it faces the carriage 5, when the sensor 9 passes the edge in the widthwise direction (X direction), the detection result of the sensor 9 changes. From this, the edge of the printing medium P is specified, and its size (in this case, the width in the X direction) can be detected. By using even a sensor used for reading of a registration adjustment pattern and the like, the size of a printing medium can be detected without arranging a dedicated sensor.

Figure 5:
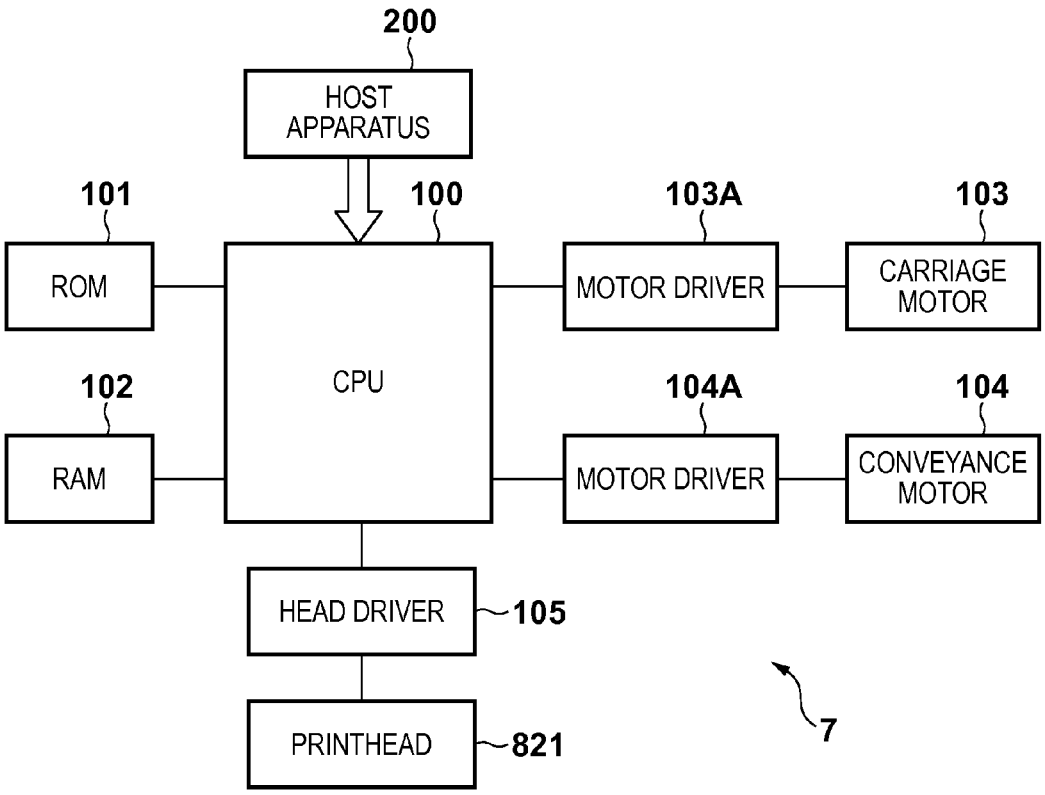
FIG. 5 is a block diagram showing a control unit.

Referring back to FIG. 1, the control unit 7 is electrically connected to the printhead 821 via a flexible wiring board 71, and performs discharge control. The discharge control also includes control of causing the printhead 821 to discharge ink for image printing, and control of causing the printhead 821 to perform preliminary discharge. The control unit 7 also performs, for example, control of a motor serving as a driving source for the moving unit 6, conveying unit 2, and the like. FIG. 5 is a block diagram showing the control unit 7.

A CPU 100 executes a control process, data process, and the like for the operation of the printing apparatus A. A ROM 101 stores programs to be executed by the CPU 100. A RAM 102 is used as, for example, a work area for executing various processes by the CPU 100. Note that the ROM 101 and RAM 102 may use other storage devices.

The printhead 821 discharges ink when the CPU 100 supplies, to a head driver 105, driving data (printing data) and driving control signals (heat pulse signals) for the heaters 8217 and 8218 and the like. The CPU 100 controls, via a motor driver 103A, a carriage motor 103 to drive the carriage 5 in the main scanning direction. Also, the CPU 100 controls, via a motor driver 104A, at least one conveyance motor 104 to convey a printing medium in the sub-scanning direction by the feeding unit 1, conveying unit 2, and discharging unit 3.

When printing by the printing apparatus A having the above-described arrangement, first, printing data received from a host apparatus 200 (see FIG. 5) by wired or wireless communication is temporarily stored in the RAM 102. The host apparatus 200 is, for example, a personal computer or mobile terminal. The conveyance motor 104 conveys a printing medium to the printing position of the printhead 821. The carriage motor 103 moves the carriage 5 to move the printhead 821 in the main scanning direction. Then, an image is printed on the printing medium by repeating a printing operation of discharging ink from the printhead 821 based on the printing data to print an image, and a conveyance operation of conveying a printing medium by the conveyance motor 104 by a predetermined amount in the sub-scanning direction.

<Control Example>

Figure 6:
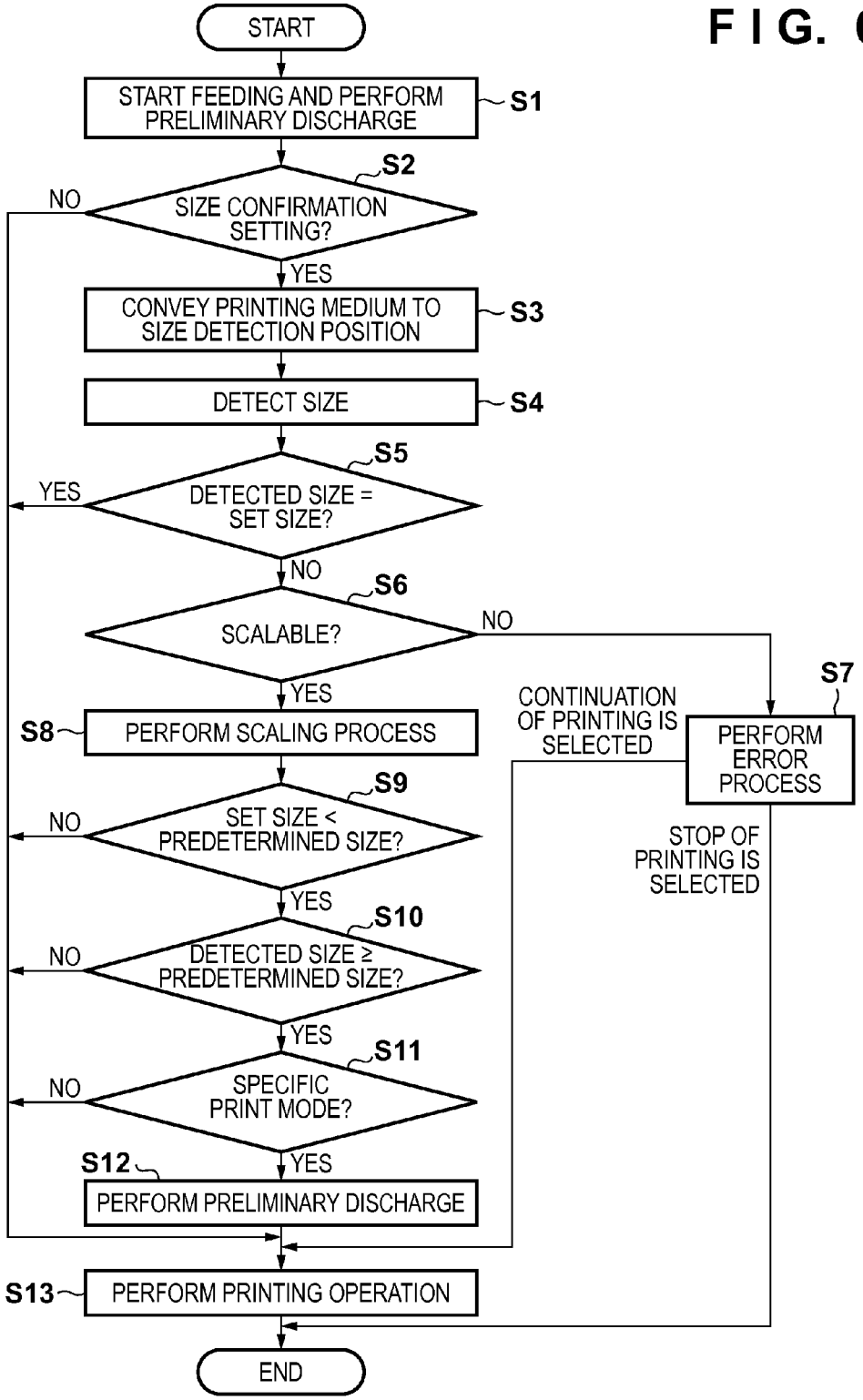
FIG. 6 is a flowchart showing an example of a process to be executed by the control unit.

Next, an example of a process to be executed by the CPU 100 will be explained with reference to FIG. 6. Upon receiving an image printing instruction and printing data from the host apparatus 200, the process in FIG. 6 starts.

Assume that the printing instruction includes information (size setting information) of the size, set on the host apparatus 200 by the user, of a printing medium on which an image is printed, a print mode setting, and a printing medium size confirmation setting. These settings are sometimes generically called user settings. At least some of the user settings can be made via the operation unit (not shown) of the printing apparatus A.

The type of print mode can include, for example, a relatively high-image-quality mode and a relatively low-image-quality mode. The type of print mode can be discriminated in accordance with the type of printing medium (for example, plain paper or photo paper). The following example assumes that a print mode for photo paper (photo print mode) and a print mode for plain paper (plain paper print mode) can be set. Assume that the print mode for photo paper is a relatively high-image-quality print mode, and the paper interval is small.

In step S1, the feeding unit 1 starts feeding a printing medium. Preliminary discharge is executed during the conveyance operation of the printing medium by the feeding unit 1. This preliminary discharge is performed based on the size setting information among the user settings. FIGS. 7A and 7B show examples of preliminary discharge.

FIG. 7A shows the discharging conditions of preliminary discharge when the printing medium size is smaller than a predetermined size. FIG. 7B shows the discharging conditions of preliminary discharge when the printing medium size is equal to or larger than the predetermined size. As the predetermined size serving as a reference, for example, the width (length in the X direction) of a printing medium is smaller than 101.6 mm, or equal to or larger than it. Both the examples in FIGS. 7A and 7B assume that photo printing is set as the print mode. Even in the plain paper print mode, the discharging conditions of preliminary discharge may be similarly set in accordance with the printing medium size, or may be uniform regardless of the size.

The examples of FIGS. 7A and 7B represent the numbers of ink droplet discharge times per nozzle. For example, an MBk nozzle discharges 100 droplets in both of the examples. Note that MBk stands for pigment black, C stands for cyan, M stands for magenta, Y stands for yellow, Gy stands for gray, and Pk stands for dye black. "Small", "middle", and "large" represent different discharge port sizes. For example, "C small" represents a relatively small discharge port for cyan ink. "C large" represents a relatively large discharge port for cyan ink. "C middle" represents a cyan ink discharge port with a middle size between "C small" and "C large".

When the printing medium size is equal to or larger than the predetermined size, the number of discharge times is increased for some nozzles, compared to a case in which the printing medium size is smaller than the predetermined size. Note that the number of discharge times may be increased for all nozzles. This preliminary discharge can maintain the ink discharge reliability. By performing preliminary discharge during the printing medium feeding operation, a decrease in printing speed can be suppressed.

Referring back to FIG. 6, in step S2, it is determined whether the printing medium size confirmation has been set in the user settings. If YES in step S2 (the size confirmation has been set), the process advances to step S3; if NO (no size confirmation has been set), the process advances to step S13.

In step S3, the printing medium fed into the apparatus main body by the feeding unit 1 is conveyed by the conveying unit 2 to a position where the sensor 9 can detect the printing medium. In step S4, the sensor 9 detects an edge of the printing medium in the X direction while moving the carriage 5 in the main scanning direction. By detecting the positions of the two edges of the printing medium, the size (in this case, width) of the printing medium can be detected. It is also possible to detect only one edge of a printing medium and estimate the size of the printing medium.

In step S5, it is determined whether the printing medium size indicated by the size setting information matches the detected size of the printing medium detected by the sensor 9. That is, it is confirmed whether the printing medium size set by the user is the size of the printing medium actually conveyed to the printing apparatus A. If these sizes match each other, the process advances to step S13; if they do not match each other, the process advances to step S6.

In step S6, it is determined whether an image to be printed can be scaled. In the embodiment, whether the image can be scaled is determined based on the data format of printing data of the image. For example, JPEG data has a data format capable of enlargement and reduction, so it is determined that this data can be scaled. If the image can be scaled, the process advances to step S8; if the image cannot be scaled, the process advances to step S7.

In step S7, an error process is performed. Here, the user is notified by, for example, an image or sound that the printing medium sizes are different and the image cannot be scaled. Also, the user is prompted to select whether to stop or continue image printing. If the user selects to continue image printing, the process advances to step S13 to print the image on the printing medium having the different size. If the user selects to stop image printing, the process for one unit ends.

In step S8, a scaling process is performed. The image to be formed on the printing medium is scaled in accordance with the size detected in step S4. For example, if the detected size is larger than the set size, printing data is processed to enlarge the image. Conversely, if the detected size is smaller than the set size, printing data is processed to reduce the image.

In steps S9 and S10, it is determined whether additional preliminary discharge is necessary as a result of the scaling process in step S8. Generally stated, in the embodiment, preliminary discharge has already been performed at the stage of feeding the printing medium (step S1). This preliminary discharge is performed based on the size setting information, and the preliminary discharge amount (number of ink discharge times) changes depending on the set size of a printing medium, as shown in FIGS. 7A and 7B. Assume that preliminary discharge is performed in the preliminary discharge amount shown in FIG. 7B in step S1, and the detected size of a printing medium is smaller than the predetermined size. In this case, the image is reduced as a result of the scaling process in step S8, and the preliminary discharge amount shown in FIG. 7A is sufficient essentially, so the necessity to additionally perform preliminary discharge is low.

In contrast, assume that preliminary discharge is performed in the preliminary discharge amount shown in FIG. 7A in step S1, and the detected size of a printing medium is equal to or larger than the predetermined size. In this case, the image is enlarged as a result of the scaling process in step S8 to enlarge the printing range. Essentially, preliminary discharge needs to be performed in the preliminary discharge amount shown in FIG. 7B. Thus, there is a necessity to perform additional preliminary discharge.

That is, preliminary discharge is performed when an image is enlarged, and is not performed when an image is not enlarged. In steps S9 and S10, whether to perform additional preliminary discharge is determined according to this concept.

First, in step S9, it is determined whether the set size of the printing medium in the user settings is smaller than a predetermined size. The predetermined size is a size serving as the determination criterion in FIGS. 7A and 7B. This also applies to step S10. If the set size of the printing medium is smaller than the predetermined size, the process advances to step S10. If the set size of the printing medium is not smaller than the predetermined size, that is, the set size of the printing medium is equal to or larger than the predetermined size, it is determined that additional preliminary discharge is unnecessary, and the process advances to step S13. In step S10, it is determined whether the printing medium size detected in step S4 is equal to or larger than the predetermined size. If the detected printing medium size is equal to or larger than the predetermined size, the process advances to step S11. If the detected printing medium size is neither equal to nor larger than the predetermined size, that is, the detected printing medium size is smaller than the predetermined size, it is determined that additional preliminary discharge is unnecessary, and the process advances to step S13.

In step S11, it is determined whether the print mode setting in the user settings is a predetermined specific print mode. If YES in step S11, the process advances to step S12; if NO, the process advances to step S13. In the embodiment, the specific print mode is the photo print mode. If the print mode setting is another mode (plain paper print mode), the process advances not to step S12 but to step S13. The reason of this will be described later.

In step S12, preliminary discharge is performed. The discharging conditions of preliminary discharge may be the same as those shown in FIG. 7B. However, in step S1, preliminary discharge has already been performed in the preliminary discharge amount shown in FIG. 7A. Thus, the preliminary discharge amount (number of ink discharge times) can be decreased in comparison with that in FIG. 7B, thereby suppressing the ink consumption and increasing the printing speed. For example, preliminary discharge can be performed in a preliminary discharge amount shown in FIG. 7C. In the example of FIG. 7C, the number of discharge times is decreased from that in the example of FIG. 7B for some nozzles. Needless to say, the number of discharge times may be decreased for all nozzles. Alternatively, additional preliminary discharge may be performed for only some nozzles.

In step S13, a printing operation is performed. After that, the process for one unit ends.

As described above, according to the embodiment, in the case of size inconsistency in which the set size of a printing medium and the size (detected size) of a printing medium actually conveyed to the printing apparatus are different, the scaling process is possible in step S8. Hence, the size inconsistency can be automatically coped with as for the image size and arrangement. As a result of scaling, the discharging conditions of necessary preliminary discharge may change. Considering this, preliminary discharge is added to the necessary extent based on the scaling result in the processes of steps S9 to S12. The size inconsistency can be automatically coped with in the recovery operation. According to the embodiment, even when the size of an actual printing medium is different from a set size, high-image-quality printing can be performed.

In the embodiment, preliminary discharge is performed at the time of feeding (step S1). However, this preliminary discharge may not be performed, and only preliminary discharge corresponding to the result of the scaling process may be performed. In this case, when scaling is unnecessary, or even when an image is reduced by the scaling process, preliminary discharge is performed in accordance with the printing medium size (image size).

Next, the reason that additional preliminary discharge is performed in step S12 when it is determined in step S11 that the print mode is the photo print mode will be described. Preliminary discharge in step S12 can also be executed regardless of the type of print mode. However, preliminary discharge is accompanied by ink consumption and a decrease in printing speed. To avoid this, whether to execute preliminary discharge is determined in accordance with the type of print mode in the embodiment.

The embodiment assumes that nozzles to be used are not limited in the plain paper print mode, and are limited in the photo print mode. It is considered that in the plain paper print mode free from the limitation of nozzles to be used, the nozzle state does not greatly degrade even if additional preliminary discharge (step S12) is not performed. Assume that in the plain paper print mode, the number of scan times necessary to complete one raster is smaller than that in the photo print mode, and the printing speed is higher. Even if nozzles to be used are limited in the plain paper print mode, additional preliminary discharge (step S12) is unnecessary.

Figure 8:
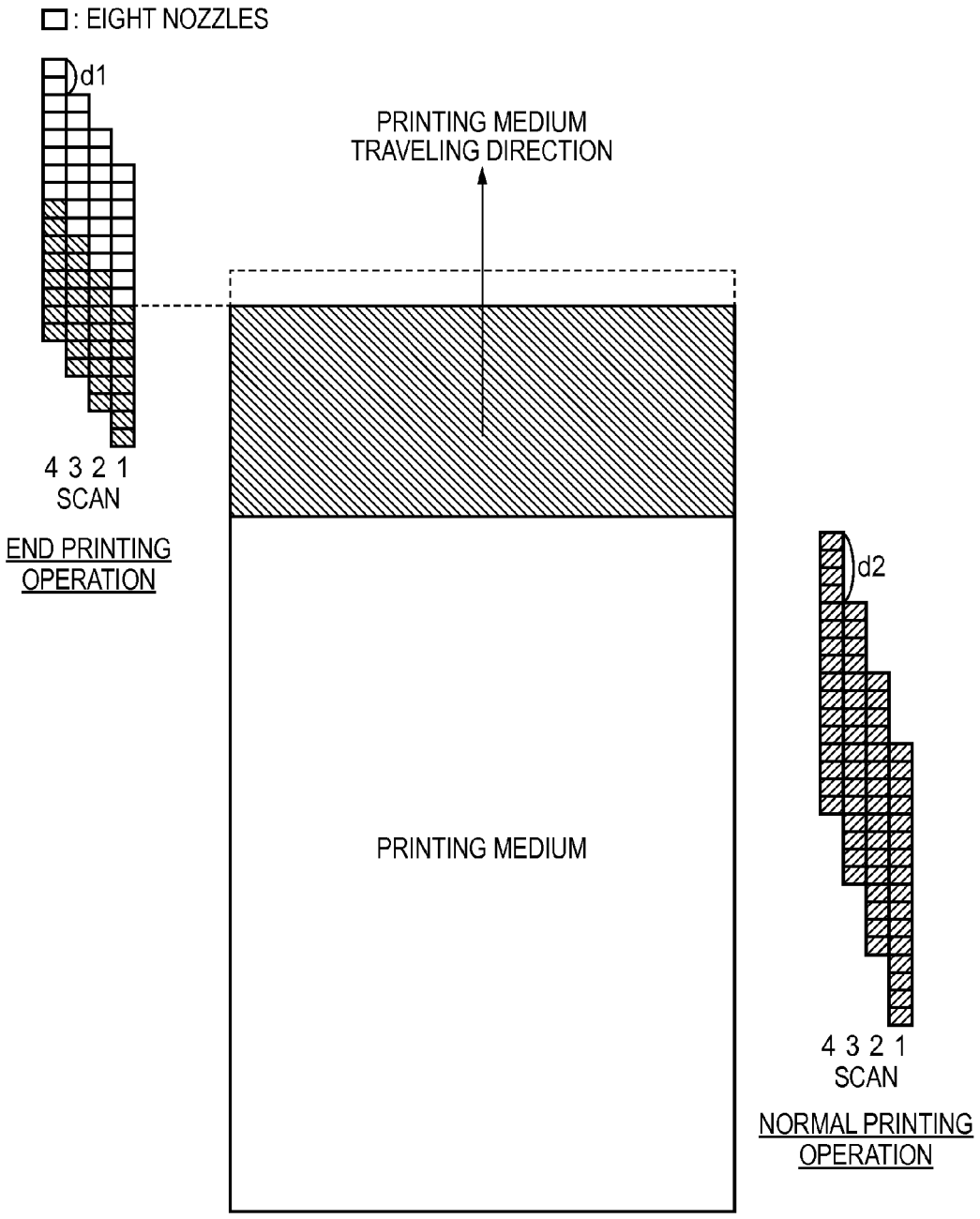
FIG. 8 is a view showing an example of switching of nozzles to be used.

The limitation of nozzles to be used will be explained with reference to FIG. 8. FIG. 8 shows the relationship between nozzles and a printing medium when a so-called natural image, person image, or the like is printed by a plurality of scans in the photo print mode. FIG. 8 is a schematic view for explaining a printing method at a portion at which the printing medium conveyance accuracy drops, such as the leading end or trailing end of a printing medium.

In FIG. 8, one rectangle represents eight nozzles. In this example, nozzles of one array are 128 nozzles. A blank rectangle represents ink discharge nozzles not to discharge ink, and a hatched rectangle represents ink discharge nozzles to discharge ink.

A printing medium moves upward in FIG. 8. When printing at the leading end of the printing medium, the printing medium is conveyed by only a pair of conveyance rollers formed from the conveyance roller 21 and pinch roller 22. The conveyance amount of one unit is set to a relatively small value d1 so as to improve the conveyance accuracy. In this example, printing by a length of 16 nozzles is completed by four carriage scans.

At the hatched portion (leading end in FIG. 8) of the printing medium, printing is performed by an "end printing operation". After printing by scan 1, the printing medium is conveyed by d1, and the next scan and printing are executed in the nozzle state of subsequent scan 2. In FIG. 8, the nozzle position differs between nozzle scans 1, 2, 3, and 4. However, in actual printing, the printing medium moves. A broken line indicates the position of the printing medium in scan 2. The paper feeding amount d1 in this example is a length of 16 nozzles.

This operation is sequentially repeated four times, completing an image of this width by corresponding scan printing operations 1 to 4. At this time, nozzles indicated by a blank rectangle, that is, not used to print are maintained by only preliminary discharge at a given time interval. When the width of a printing medium is large, the time of the maintenance state becomes long.

In this example, printing by a length of 16 nozzles is completed by four scans for simplicity. However, when executing photo printing of a natural image, person image, or the like by using glossy paper, coated paper, or the like, 16 scans, 24 scans, or the like are used. The length of nozzles to be simultaneously used, and the conveyance length also become short. This prolongs the maintenance time for only preliminary discharge of unused nozzles.

When the printing medium reaches the discharging unit 3 (discharging roller), it is conveyed by a pair of two rollers, improving the conveyance accuracy. Thus, the printing operation is performed by a "normal printing operation". The conveyance amount of one unit becomes d2 (>d1). The number of nozzles to be used also increases. In this example, the conveyance amount d2 is a length of 32 nozzles. An image is completed using all 128 nozzles by four scans.

When the "end printing operation" shifts to the "normal printing operation", some nozzles switch from unused nozzles to nozzles to be used. In this case, such nozzles are 64 nozzles in the printing medium conveyance direction. It is highly necessary to prevent an ink discharge failure for these nozzles. In the photo print mode, therefore, an ink discharge failure can be more reliably prevented by performing additional preliminary discharge (step S12). As described above, additional preliminary discharge (step S12) may be performed for only some nozzles. In this case, additional preliminary discharge may target nozzles which switch from unused nozzles to nozzles to be used.

Second Embodiment

Figure 9:
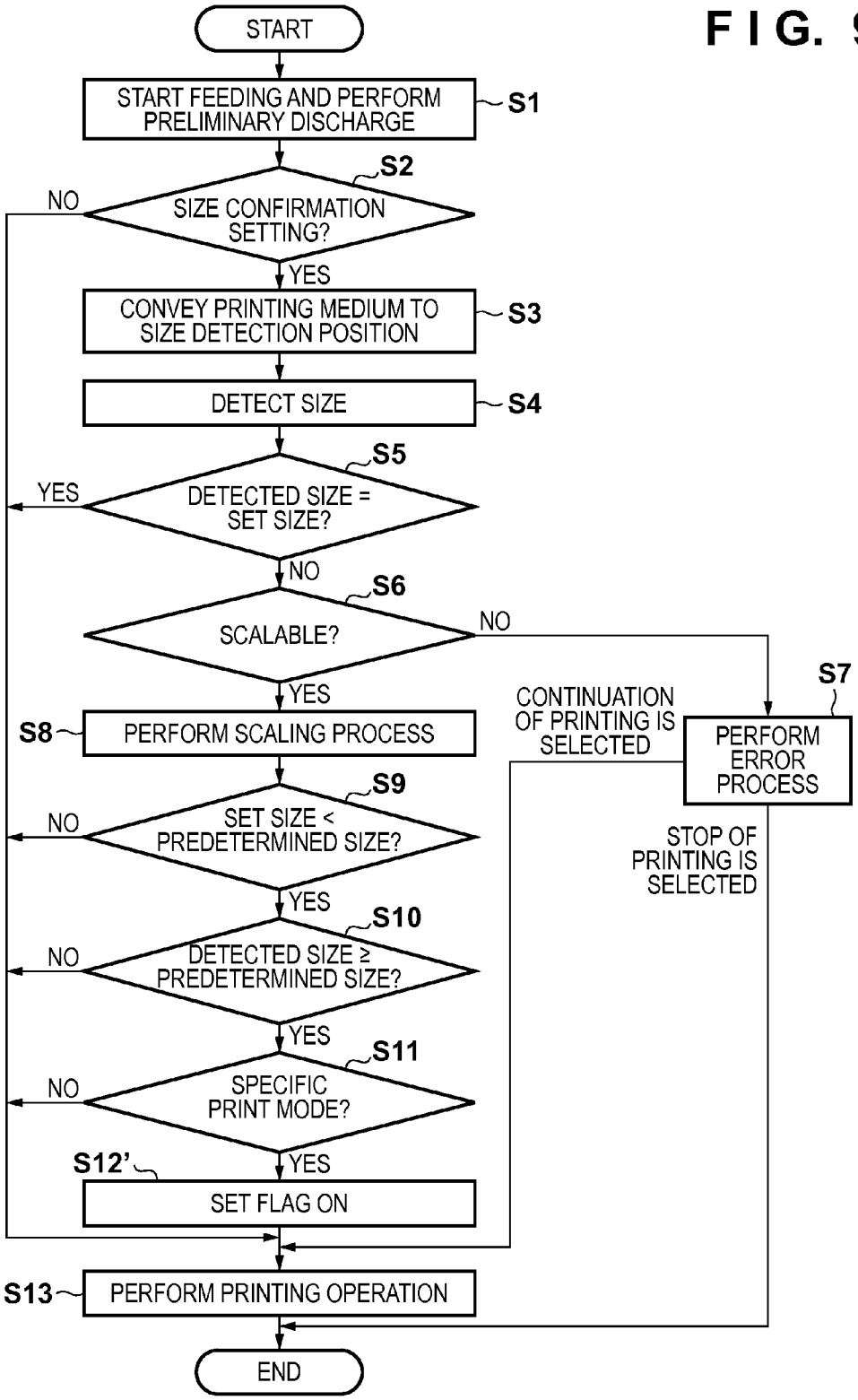
FIG. 9 is a flowchart showing an example of a process to be executed by the control unit.
Figure 10:
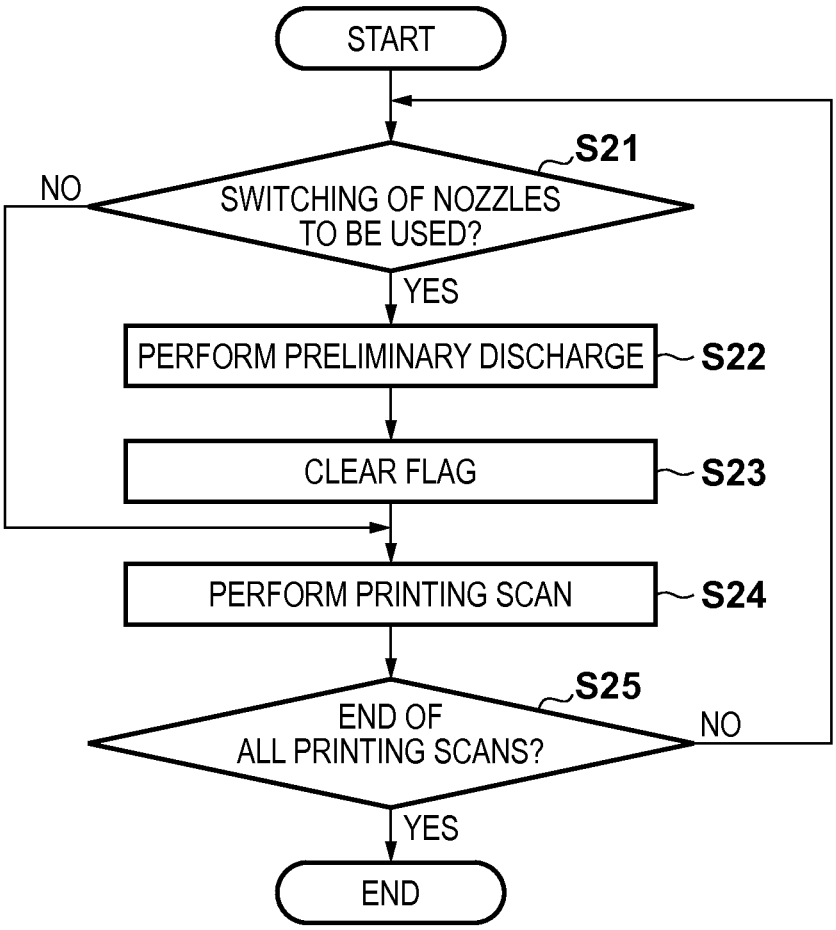
FIG. 10 is a flowchart showing an example of a process to be executed by the control unit.

In the first embodiment, additional preliminary discharge (step S12) is performed after preliminary discharge in step S1 and before image printing by the printhead 821. However, additional preliminary discharge may be performed after the start of image printing and before image printing in a predetermined region on a printing medium. For example, additional preliminary discharge (step S12) can be performed immediately before the "end printing operation" shifts to the "normal printing operation". FIGS. 9 and 10 are flowcharts showing an example of a process in this case.

Referring to FIG. 9, steps S1 to S11 are the same processes as steps S1 to S11 in the first embodiment, and a description thereof will not be repeated. The second embodiment employs step S12' instead of step S12 in the first embodiment. In step S12', a flag is set to be ON without executing preliminary discharge. This flag is a reservation flag which is set using a partial recording area of a RAM 102 and represents the reservation of preliminary discharge.

FIG. 10 shows a process example of a printing operation in step S13 according to the second embodiment. Before print scanning of each raster, it is determined in step S21 whether to switch nozzles to be used. If YES in step S21, the process advances to step S22; if NO, the process advances to step S24. For example, a case in which the "end printing operation" shifts to the "normal printing operation", which has been described with reference to FIG. 8, corresponds to switching of nozzles to be used.

In step S22, preliminary discharge is executed. This preliminary discharge can have the same contents as those of preliminary discharge in step S12 according to the first embodiment. In step S23, the reservation flag is cleared. In step S24, print scanning is executed. In step S25, it is determined whether all print scans have been completed. If NO in step S25, the process returns to step S21; if YES, the process for one unit ends.

Third Embodiment

Figure 11:
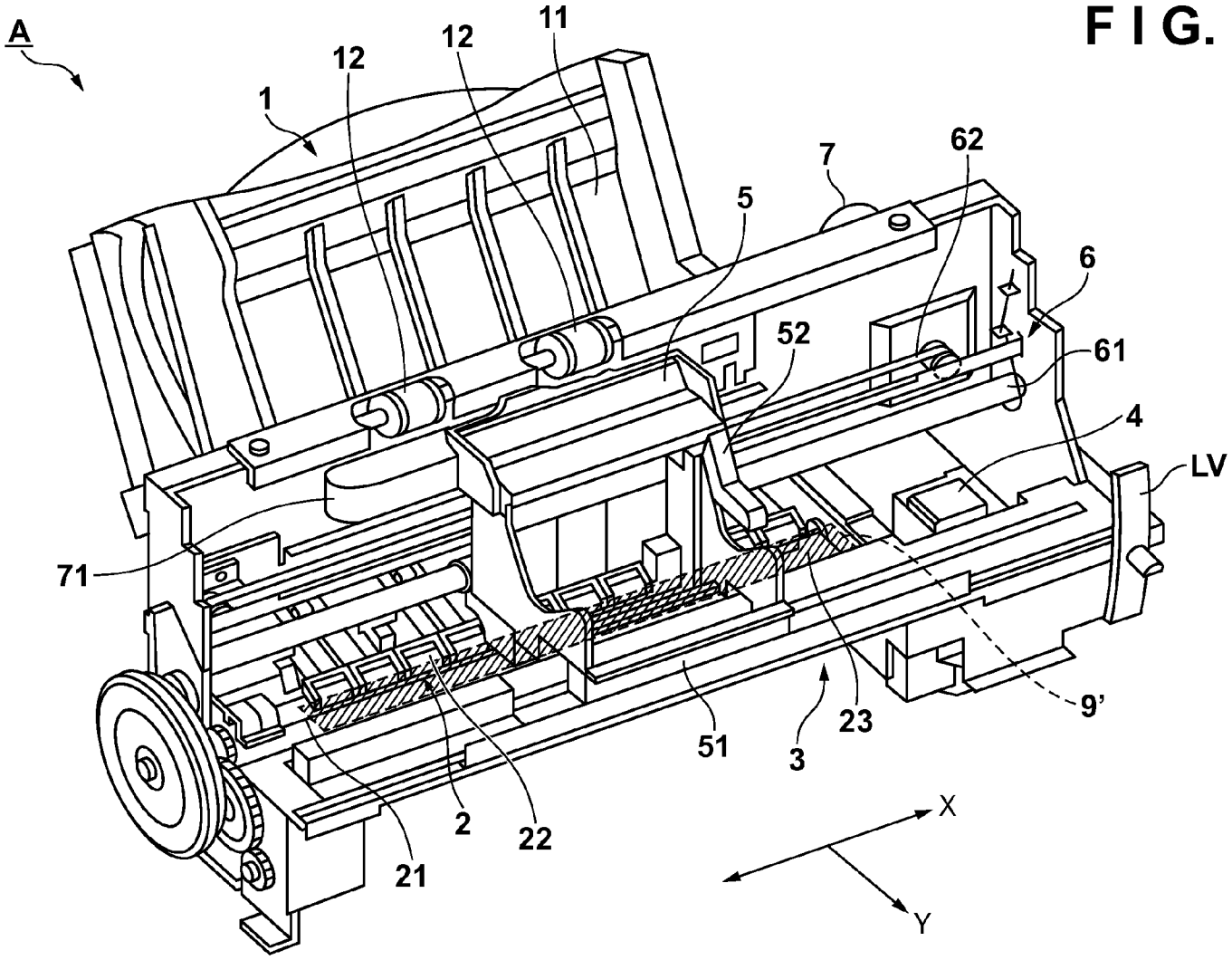
FIG. 11 is a view for explaining a sensor in another example.

In the first and second embodiments, the sensor 9 is arranged on the carriage 5. However, another arrangement example can also be adopted. FIG. 11 shows an example of the arrangement. A sensor 9' in FIG. 11 is fixed inside a platen 23. FIG. 11 is a partially perspective view showing the sensor 9' in order to indicate the position of the sensor 9'.

The sensor 9' is statically arranged and can detect printing media of respective sizes varying from a minimum size to a maximum one, the use of which is assumed in a printing apparatus A. For example, the sensor 9' may be constituted by arranging an optical sensor at a position corresponding to each size, or may be a line sensor. The sensor is arbitrary as long as it can detect printing media of respective sizes. In the arrangement according to the third embodiment, the size of a printing medium can be detected without moving a carriage 5, and a decrease in printing speed can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2013-163648, filed Aug. 6, 2013, which is hereby incorporated by reference herein in its entirety.

What is claimed is:

1. A printing apparatus comprising:

a printhead configured to print an image by discharging ink to a printing medium;

a preliminary discharge unit configured to cause said printhead to perform preliminary discharge;

a detecting unit configured to detect a size of a printing medium on which an image is to be printed; and a scaling process unit configured to, when a size of a printing medium indicated by size setting information and a detected size of the printing medium that has been detected by said detecting unit do not match each other, scale the image to be formed on the printing medium in accordance with the detected size, wherein said preliminary discharge unit is configured to cause said printhead to perform preliminary discharge in accordance with a scaling result of said scaling process unit.

2. A printing apparatus comprising:

a printhead configured to print an image by discharging ink to a printing medium;

a detecting unit configured to detect a size of a printing medium on which an image is to be printed;

a scaling process unit configured to, when a size of a printing medium indicated by size setting information and a detected size of the printing medium that has been detected by said detecting unit do not match each other, scale the image to be formed on the printing medium in accordance with the detected size;

a first preliminary discharge unit configured to cause said printhead to perform preliminary discharge based on the size setting information; and a second preliminary discharge unit configured to cause said printhead to perform preliminary discharge in accordance with a scaling result of said scaling process unit.

3. The apparatus according to claim 2, wherein said second preliminary discharge unit is configured to cause said printhead to perform preliminary discharge when said scaling process unit enlarges the image, and said second preliminary discharge unit is configured not to cause said printhead to perform preliminary discharge when said scaling process unit does not enlarge the image.

4. The apparatus according to claim 3, wherein even when said scaling process unit enlarges the image, if printing is not performed in a predetermined specific print mode, said second preliminary discharge unit is configured not to cause said printhead to perform preliminary discharge.

5. The apparatus according to claim 2, wherein said printhead includes a plurality of discharge ports configured to discharge ink, and said second preliminary discharge unit is configured to cause said printhead to perform preliminary discharge for some of the plurality of discharge ports.

6. The apparatus according to claim 2, wherein said printhead includes a plurality of discharge ports configured to discharge ink, when the size setting information indicates a first size, said first preliminary discharge unit is configured to cause said printhead to perform preliminary discharge under a first discharging condition, and when the size setting information indicates a second size larger than the first size, said first preliminary discharge unit is configured to cause said printhead to perform preliminary discharge under a second discharging condition, and in the second discharging condition, the number of ink discharge times is larger than that in the first discharging condition for at least some of the plurality of discharge ports.

7. The apparatus according to claim 6, further comprising:

a feeding unit configured to convey a printing medium;

a conveying unit disposed downstream in a conveyance direction of the printing medium with respect to said feeding unit, and configured to convey the printing medium; and a discharge unit disposed downstream in the conveyance direction with respect to said conveying unit, and configured to convey the printing medium, wherein said printhead is interposed between said conveying unit and said discharging unit, and said first preliminary discharge unit is configured to cause said printhead to perform preliminary discharge during a conveyance operation by said conveying unit.

8. The apparatus according to claim 7, wherein preliminary discharge by said second preliminary discharge unit is performed after preliminary discharge by said first preliminary discharge unit and before image printing by said printhead.

9. The apparatus according to claim 7, wherein preliminary discharge by said second preliminary discharge unit is performed after a start of image printing by said printhead and before image printing in a predetermined region on a printing medium.

10. The apparatus according to claim 7, further comprising a carriage configured to mount said printhead and move in a direction perpendicular to the conveyance direction, wherein said detecting unit is disposed on said carriage.

11. The apparatus according to claim 7, wherein said detecting unit is disposed on a platen facing said printhead.

12. A method of controlling a printing apparatus including a printhead configured to print an image by discharging ink to a printing medium, comprising:

a detecting step of detecting a size of a printing medium on which an image is to be printed;

a scaling process step of, when a size of a printing medium indicated by size setting information and a detected size of the printing medium that has been detected in the detecting step do not match each other, scaling the image to be formed on the printing medium in accordance with the detected size; and a preliminary discharge step of causing the printhead to perform preliminary discharge in accordance with a scaling result of the scaling process step.

13. A printing apparatus comprising:

a printhead configured to print an image by discharging ink to a printing medium;

a detecting unit configured to detect a size of a printing medium on which an image is to be printed;

a scaling process unit configured to, when a size of a printing medium indicated by size setting information and a detected size of the printing medium that has been detected by said detecting unit do not match each other, perform a scaling process for scaling the image to be formed on the printing medium in accordance with the detected size; and a control unit configured to cause said printhead to perform a first preliminary discharge operation based on the size setting information, wherein said control unit is configured to, when the image is enlarged by the scaling process, cause said printhead to perform a second preliminary discharge operation based on the detected size detected by said detecting unit after the first preliminary discharge operation.

14. The apparatus according to claim 13, wherein, when the image is reduced by the scaling process, said control unit is configured not to cause said printhead to perform the second preliminary discharge operation after the first preliminary discharge operation.

15. The apparatus according to claim 13, wherein, even when the image is enlarged by the scaling process, if printing is not performed in a predetermined specific print mode, said control unit is configured not to cause said printhead to perform the second preliminary discharge operation.

16. The apparatus according to claim 13, wherein said printhead includes a plurality of discharge ports configured to discharge ink, and said control unit is configured to cause some of the plurality of discharge ports to perform the second preliminary discharge operation.

17. The apparatus according to claim 13, wherein said printhead includes a plurality of discharge ports configured to discharge ink, said control unit is configured to, when the size setting information indicates a first size, cause said printhead to perform the first preliminary discharge operation under a first discharging condition, said control unit is configured to, when the size setting information indicates a second size larger than the first size, cause said printhead to perform the first preliminary discharge operation under a second discharging condition, and in the second discharging condition, the number of ink discharge times is larger than that in the first discharging condition for at least some of the plurality of discharge ports.

18. The apparatus according to claim 13, further comprising:

a feeding unit configured to convey a printing medium;

a conveying unit disposed downstream in a conveyance direction of the printing medium with respect to said feeding unit, and configured to convey the printing medium; and a discharge unit disposed downstream in the conveyance direction with respect to said conveying unit, and configured to convey the printing medium, wherein said printhead is disposed between said conveying unit and said discharging unit, and said control unit is configured to cause said printhead to perform the first preliminary discharge operation during a conveyance operation by said conveying unit.

19. The apparatus according to claim 13, wherein said control unit is configured to cause said printhead to perform the second preliminary discharge operation before image printing by said printhead.

20. The apparatus according to claim 13, further comprising a carriage configured to mount said printhead and move in a direction perpendicular to a conveyance direction of the printing medium, wherein said detecting unit is disposed on said carriage.

* * * * *